United States Patent [19]

Robertson

[11] 4,424,849

[45] Jan. 10, 1984

[54] INTERIOR WINDOW COVERING

[76] Inventor: Johnye M. Robertson, 5108 S. Colony Blvd., The Colony, Tex. 75056

[21] Appl. No.: 332,753

[22] Filed: Dec. 21, 1981

[51] Int. Cl.[3] ..... A47H 1/00

[52] U.S. Cl. ..... 160/124; 160/84 R; 160/330

[58] Field of Search ..... 160/84 R, 124, 231 R, 160/231 A, 330, 348

[56] References Cited

U.S. PATENT DOCUMENTS

| | | | |
|---|---|---|---|
| 2,326,454 | 8/1943 | Gentile | 160/236 |
| 2,621,728 | 12/1952 | Anderson | 160/348 |
| 2,623,215 | 12/1952 | Newman | 160/348 |
| 2,625,689 | 1/1953 | Whewell | 160/330 |
| 2,667,218 | 1/1954 | Collins | 160/84 R |
| 2,996,116 | 8/1961 | Hudson | 160/348 |
| 3,254,462 | 6/1966 | Toler | 160/231 A |
| 3,443,860 | 5/1969 | Luboshez | 160/84 R |
| 3,481,388 | 12/1969 | Smart | 160/231 |
| 3,851,699 | 12/1974 | Shapiro | 160/166 |
| 4,019,554 | 4/1977 | Rasmussen | 160/85 R |
| 4,020,826 | 5/1977 | Mole | 126/270 |
| 4,049,038 | 9/1977 | Hyman et al. | 160/166 A |
| 4,188,991 | 2/1980 | Boyle | 160/124 |

*Primary Examiner*—Peter M. Caun

*Attorney, Agent, or Firm*—Charles D. Gunter, Jr.

[57] ABSTRACT

An interior window covering is shown of the type adapted to be supported adjacent a window in the manner of a vertical blind. The window covering includes an inner fabric panel, an outer fabric panel which overlays the inner panel and which is secured thereto by a series of vertical spaced-apart seams, whereby a series of vertical pockets is formed between the inner and outer panels. A plurality of bowed slats are disposed within the vertical pockets. Each of the slats is separated from the next adjacent slat by one of the vertical seams to allow collapsing of the window covering by folding the seams to form a stack of the vertical pockets.

2 Claims, 3 Drawing Figures

INTERIOR WINDOW COVERING

BACKGROUND OF THE INVENTION

The present invention relates to window coverings used inside the house which combine the desirable features of vertical type window blinds and conventional window drapes and which conserve energy by inhibiting drafts and reducing solar radiation.

The use of adjustable louver type vertical blinds is known. Also, draw drapes have been known and used for many years and are often preferred for use in the home over vertical blinds for esthetic reasons. Prior vertical window blind designs, while highly functional, have generally lacked the esthetic qualities provided in window coverings formed of fabric panels capable of being draped.

Another function of draperies and blinds, besides providing privacy in the residential dwelling, is to reduce heat absorption through the window opening during the warmer months and to prevent heat dissipation through the window during the colder months. Previous drapery designs have been used primarily for ornamental purposes and to provide privacy and their energy conservation effects have been minimal. Double hung draperies, while serving to reduce heat absorption or dissipation through the window, have generally been clumsy and unattractive. Typical venetian blind construction does not serve to effectively reduce solar radiation entering a room through a glass window or to prevent heat loss from the room to the exterior of the dwelling.

Another approach to energy conservation with respect to windows has been to apply a reflective film directly to the glass. This approach is effective in reducing solar radiation and minimizes solar heating thereby reducing air conditioning requirements of the room during the warmer months. However, this solution prevents solar heating of the room during the cooler months of the year and thus increases energy costs for heating during the winter. The reflective coatings on the window are also considered by some to detract from the appearance of the window.

SUMMARY OF THE INVENTION

The interior window covering of the present invention is adapted to be supported adjacent a window in the manner of a vertical blind. The window covering includes an inner fabric panel located proximate the window. An outer fabric panel overlays the inner fabric panel on the side of the inner panel opposite the window. The outer panel is secured to the inner panel by a series of vertical, spaced-apart seams, whereby a series of vertical pockets is formed between the inner and outer panels. A plurality of slats are disposed within the vertical pockets, each of the slats being separated from the next adjacent slat by one of the vertical seams to allow collapsing of the window covering by folding the seams to form a stack of the vertical pockets.

Preferably, the slats are bowed members having a concave surface and an opposite convex surface. The slats are inserted into the vertical pockets with the concave surfaces facing the inner fabric panel, thereby creating an air space between the inner fabric panel and the slats. To further reduce heat absorption, the bowed member concave surfaces are light reflective and the inner fabric panel is provided with an insulated lining.

Additional objects, features, and advantages will be apparent from the description which follows.

DETAILED DESCRIPTION OF THE INVENTION

Figure 1:
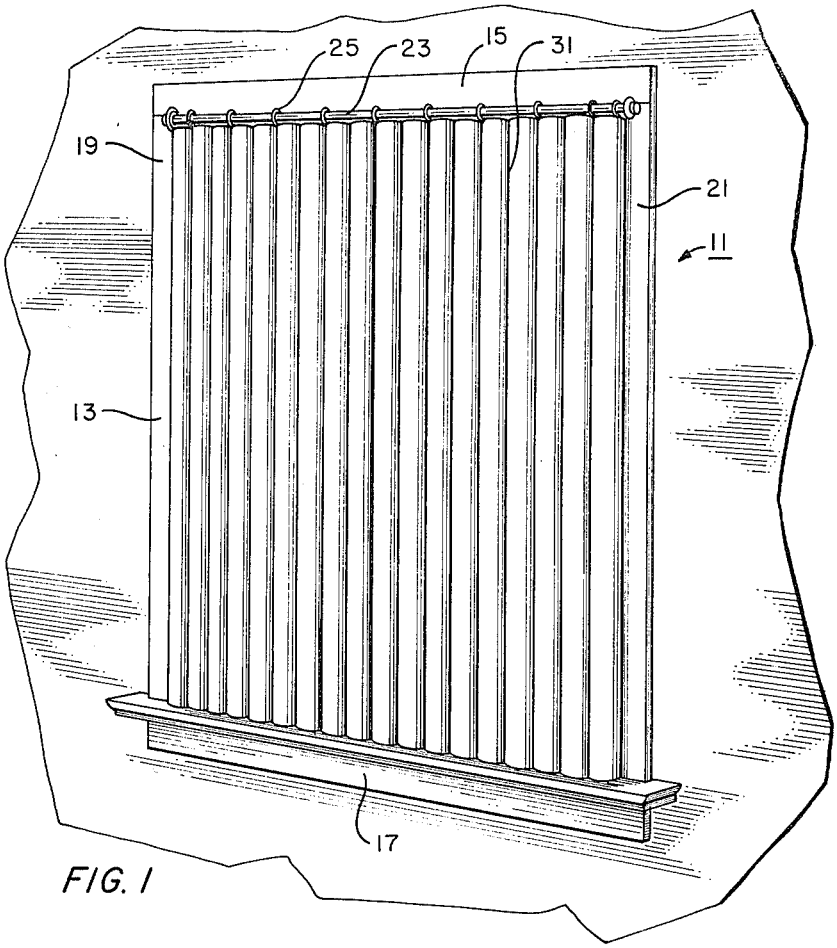
FIG. 1 is a perspective view of the window covering of the present invention in place in an interior window.

Turning now to FIG. 1, there is shown an interior window covering of the present invention designated generally as 11. Interior window covering 11, as shown in FIG. 1, is adapted to be supported in a window 13. Window 13 comprises top and bottom ledges 15, 17 and vertical side frames 19, 21.

An elongated horizontal mounting member, in this case curtain rod 23, extends between vertical side frames 19, 21 near the tops thereof and has a plurality of movable support members, such as curtain rings 25, carried thereon. Rings 25, in turn, support the window covering as will be more fully described later.

Figure 2:
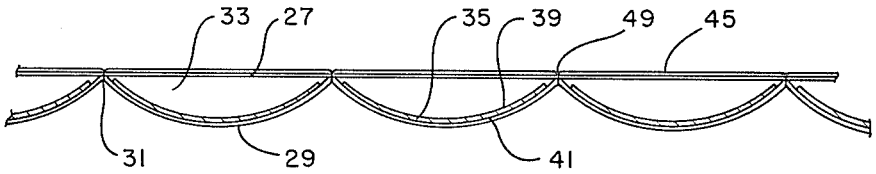
FIG. 2 is a sectional view of the window covering of FIG. 1 showing the bowed slats in place within the vertical pockets.

As shown in FIG. 2, the window covering 11 includes an inner fabric panel 27 located proximate the window glass. An outer fabric panel 29 overlays the inner fabric panel on the side of the inner panel 27 opposite the window glass. The outer fabric panel 29 is secured to the inner panel by a series of vertical, spaced-apart seams 31. Preferably seams 31 are formed by stitching the inner and outer fabric panels together, whereby a series of vertical pockets 33 are formed between the inner and outer panels 27, 29. Instead of being sewn, seams 31 can be formed by glue or other adhesive materials or any satisfactory method of securing the inner and outer panels 27, 29. However, stitching the inner and outer panels, is preferred because of the pleasing esthetic appearance created by the transmission of light passing through the window glass and through the designs formed by the stitched seams. Once seams 31 are sewn into the fabric panels, pockets 33 are arranged in parallel relation normal to the longitudinal axis of the mounting member 23.

A plurality of slats 35 are disposed within vertical pockets 33 and extend substantially the entire length of the vertical pockets 33. Each of the slats 35 is separated from the next adjacent slat (37 in FIG. 2) by one of the vertical seams 31 to allow collapsing of the window covering 11 by folding the seams 31 to form a stack of the vertical pockets 33 as shown in FIG. 3.

As shown in FIG. 2, the slats 35 can be bowed members having a concave surface 39 and an opposite convex surface 41. Preferably, the slats 35 are inserted into the vertical pockets 33 with the concave surfaces 39 facing the inner fabric panel 27, thereby creating an air space between the inner fabric panel 27 and the slats 35. Alternatively, to create a different esthetic appearance, the slats 35 can be inserted in alternating fashion in pockets 33 with alternating concave and convex surfaces 39, 41 facing panel 27. Any convenient slat material can be utilized such as venetian blind material or chain-link fence lattice material. Preferably slats 35 are polished aluminum curved slats having a light reflective concave surface. Such a light reflective surface can be provided by polishing or mirroring the aluminum slat or by providing a white surface if another type slat material is utilized. The preferred venetian blind slats are approximately 2 inches in width and the vertical pockets 33 are provided of slightly larger width to conveniently receive the slats. The degree of curvature of the slat should be such that approximately $\frac{1}{4}$ to $\frac{5}{8}$ inch of space is provided between the inner fabric panel and the top point 43 of the arch formed by concave surface 39. Approximately $\frac{1}{4}''$ to $\frac{5}{8}''$ air space has proved to be an effective heat barrier. More than about $\frac{5}{8}$ inch of air space within pockets 33 has not proved to be beneficial in reducing heat transmission.

By providing light weight, curved aluminum slats with reflective concave surfaces 39 heat transmission through window covering 11 is reduced while maintaining a pleasing esthetic appearance. If additional energy conservation is required such as in those geographic area having extreme summer temperatures, an insulating lining 45 can be provided to back the inner fabric panel 27. Insulated lining 45 can be fabricated from known heat-reflective materials, such as vinyl-backed cotton material having a silvered or metallic polyester film 47 secured to one side to serve as a reflective surface. Lining 45 can be provided with a series of seams 49 so that the window covering can be collapsed with the seams being folded to form a stack of vertical pockets 33.

Figure 3:
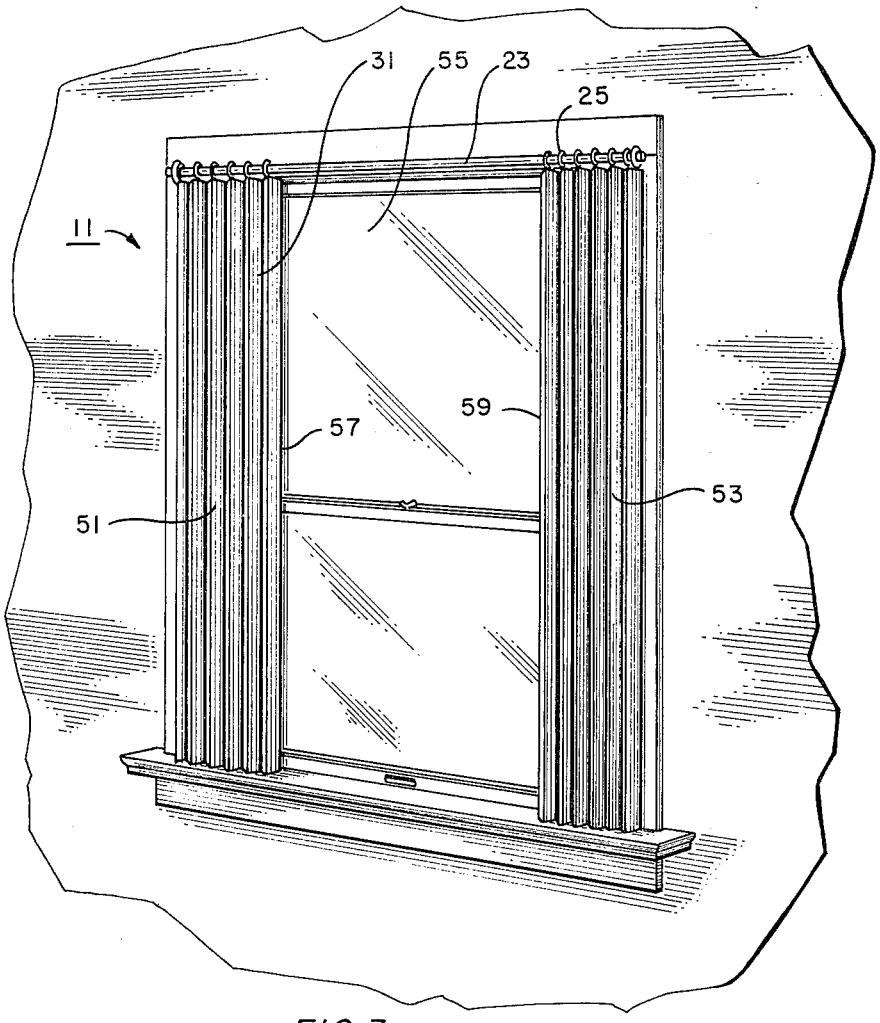
FIG. 3 is a perspective view of the window covering of FIG. 1 showing the matching sections of the covering collapsed so that the window is uncovered.

As shown in FIG. 3, the window covering 11 is preferably provided in two matching sections 51, 53 of approximately equal width supported by support members 25 whereby covering 11 covers the window glass 55 when sections 51, 53 are uncollapsed and whereby the window glass 55 is substantially uncovered when the sections 51, 53 are collapsed. The sections are collapsed by folding the pockets 33 accordion-fashion to form stacks of the vertical pockets 33 as shown in FIG. 3. When the matching sections 51, 53 are uncollapsed, the inner leading edges 57, 59 of the sections are overlapped by a distance of approximately one vertical pocket to provide increased insulating effect.

An invention has been provided with significant advantages. The present interior window covering provides the pleasing esthetic appearance of a drape while providing many of the functional aspects of a window blind. The present window covering is lightweight and pleasing in appearance and can provide privacy while also reducing heat transmission through the window when in the uncollapsed state. During cooler seasons, the window covering sections can be collapsed accordian-fashion to allow sunlight into the interior of the dwelling during the day and uncollapsed to prevent heat dissipation from the room at night. Decorative stitching can be used to provide the vertical seams which provides a striking esthetic appearance when the window covering is uncollapsed and exposed to the sunlight. The present window covering provides insulating effects comparable to older bulky double draped designs while remaining lightweight and airy in appearance. If increased insulation is necessary an insulated lining is easily provided as a backing for the inner fabric panel.

The present invention provides reduced radiant, conductive, and convective heat transfer in a unitary window covering design. The slat reflective surfaces provide reduced radiant heat transfer while the air space within the fabric pockets reduces conductive heat transfer. The solid fabric construction formed by the inner and outer fabric panels provides reduced convective heat transfer.

The present design has the additional advantage of providing an effective noise barrier since the metal and fabric design has been found to be more effective in reducing noise than either metal or fabric window coverings above.

While the invention has been shown in only one of its forms, it is not thus limited but is susceptible to various and changes modifications without departing from the spirit thereof.

I claim:

1. An interior window covering adapted to be supported adjacent a window in the manner of a vertical blind, comprising:

an inner fabric panel located proximate said window;

an outer fabric panel overlaying said inner fabric panel on the side of said inner panel opposite said window, said inner and outer panels providing a solid fabric construction adapted to reduce convective heat transfer through said cocerning, said outer panel being secured to said inner panel by a series of vertical spaced-apart sewn seams, whereby a series of vertical pockets is formed between said inner and outer panels;

a plurality of metal slats disposed within said vertical pockets and extending substantially the entire length of said vertical pockets, each of said slats being separated from the next adjacent slat by one of said vertical seams to allow collapsing of said window covering by folding said seams to form a stack of said vertical pockets; and each of said slats having a concave surface and an opposite light reflective convex surace, said slats being inserted into said vertical pockets with said concave reflective surfaces facing said inner fabric panel, thereby creating an air space between said inner fabric panel and said slats, whereby said slat reflective surfaces provide reduced radient heat transfer and said air space provides reduced conductive heat transfer through said covering.

2. An interior window covering adapted to be supported adjacent a window in the manner of a vertical blind, comprising:

an elongated horizontal mounting member having a plurality of movable support members carried thereon;

an inner fabric panel located proximate said window and carried by said support members;

an outer fabric panel overlaying said inner fabric panel on the side of said inner panel opposite said window and carried by said support members, said outer panel being secured to said inner panel by a series of vertical, spaced-apart sewn seams, whereby a series of vertical pockets is formed between said inner and outer panels, said pockets being arranged in parallel relation normal to the longitudinal axis of said mounting member;

a plurality of metal slats disposed within said vertical pockets, and extending substantially the entire length of said vertical pockets, each of said slats being separated from the next adjacent slat by one of said vertical seams to allow collapsing of said window covering by folding said seams to form a stack of said vertical pockets, said slats being bowed members having a concave surface and an opposite convex surface, said slats being inserted into said vertical pockets with said concave surfaces facing said inner fabric panel, thereby creating an air space between said inner fabric panel and said slats; and said window covering being provided in two matching sections of approximately equal width supported by said support members whereby said covering covers said window when said sections are uncollapsed and whereby said window is substantially uncovered when said sections are collapsed.

* * * * *